United States Patent [19]

Kuyper

[11] Patent Number: 4,504,441

[45] Date of Patent: Mar. 12, 1985

[54] METHOD OF PREVENTING SEGREGATION OF METAL POWDERS

[75] Inventor: Geoffrey S. Kuyper, Addison, Ill.

[73] Assignee: AMSTED Industries Incorporated, Chicago, Ill.

[21] Appl. No.: 519,516

[22] Filed: Aug. 1, 1983

[51] Int. Cl.[3] ..... B22F 1/00; B22F 1/02

[52] U.S. Cl. ..... 419/35; 419/36; 419/37; 419/39; 419/64; 427/221

[58] Field of Search ..... 419/36, 37, 35, 39, 419/64; 427/221

[56] References Cited

U.S. PATENT DOCUMENTS

| | | | |
|---|---|---|---|
| 2,097,671 | 11/1937 | Koehring et al. | 419/37 X |
| 3,410,684 | 11/1968 | Printz | 419/36 X |
| 3,892,644 | 7/1975 | Borg et al. | 204/177 X |
| 4,256,676 | 3/1981 | Kovach | 264/9 |
| 4,327,186 | 4/1982 | Murata et al. | 501/92 |

FOREIGN PATENT DOCUMENTS

| | | | |
|---|---|---|---|
| 169702 | 12/1981 | Japan | 419/37 |

*Primary Examiner*—Leland A. Sebastian

*Attorney, Agent, or Firm*—Charles E. Bouton; Fred P. Kostka

[57] ABSTRACT

The present invention provides a method of preventing the segregation of powders of different specific gravities in a metal powder composition. The powder metal is admixed with the powders of lesser specific gravities, and furfuryl alcohol is added at the same time. While mixing, an acid is added to react with the furfuryl alcohol to convert the alcohol to a solid resin film on the powder metal particles. The powders of lesser specific gravities are bonded to the metal powder particles by the resin, and segregation of the metal powder and the lighter powders is eliminated.

5 Claims, No Drawings

METHOD OF PREVENTING SEGREGATION OF METAL POWDERS

BACKGROUND AND SUMMARY OF THE INVENTION

The present invention relates to metal powder compositions and more particularly to a method for preventing the segregation of powders of differing specific gravities.

Admixed powders having differing specific gravities tend to segregate during movement, flow or vibration. Such segregation is undesirable because subsequent compaction and sintering of a segregated powder mix may well produce final products having imperfections and non uniform physical characteristics. This problem arises frequently in the formation of powder metal parts where the basic powder metal is low carbon steel, stainless steel, tool steel, high alloy steel or, in fact, any steel where a low specific gravity powder such as graphite is added. As more fully explained in U.S. Pat. No. 4,121,927, the graphite is used to remove or limit the formation of oxides from the powder metal and also to provide the alloying element for the final composition of the metal product.

The graphite, having a much lower specific gravity than the metallic powder with which it is mixed, tends to segregate during any movement or flow of the mixture or even from vibrations during storage. Segregation even occurs during compaction. The present invention provides a method for eliminating such segregation. The present method is also effective for preventing segregation from metal powder of such additives such as silicon, boron, phosphorus or other powders which have a lower specific gravity than the metallic powder with which it is being mixed.

It is known to add a lubricant such as Acrawax (trademark), in powder form, to the admixed powders to provide lubrication during the compacting process. The usual amount of such lubricant is about 1% by weight of the total powder.

When small amounts (up to 1% by weight) of lower specific gravity powder such as graphite are admixed with the metallic powder, the wax lubricant helps to prevent segregation. But when higher percentages of powder additives are necessary, segregation will occur despite the wax lubricant.

Accordingly, it is an object of the present invention to prevent the segregation of lower specific gravity powders added to a metallic powder.

The present invention prevents the segregation of lower specific gravity powders such as graphite when added to a metallic powder. In the method of the present invention, furfuryl alcohol is mixed with the powder metal and the lower specific gravity powder. During mixing, an acid such as toluene sulfonic acid is added to convert the alcohol to a solid resin film on the powder metal particles. The cured resin acts as a binder to bond the lighter powders to the metal powder and virtually eliminate all possibility of segregation.

The concentration and the amount of the acid can be adjusted so that the polymerization of the alcohol takes place while the blend is in motion during mixing. By the present method, the powder metal blend remains dry and free flowing, and the furfuryl alcohol resin does not bind the powder into a solid mass. The flowability of the powder blend of the present invention has proven superior to that of a powder metal blend utilizing a wax lubricant. However, wax lubricants can be used with the blend of the present invention for die lubrication purposes.

Since furfuryl alcohol contains a large amount of carbon, approximately one-half of the alcohol added is converted to carbon, and is dissolved in the metal powder along with the lower specific gravity powder, which is graphite in many cases, during subsequent sintering after compaction.

DESCRIPTION OF SPECIFIC EMBODIMENTS

EXAMPLE 1

A quantity of 2.268 kilograms of type 316 stainless steel powder of conventional mesh was added to a commercial blender. While mixing, 23 ml (1% by weight) toluene sulfonic acid, 60 gm (2.5% by weight) of graphite powder and 11 ml (0.5% by weight) furfuryl alcohol were added to the blender. 1% by weight Acrawax was then added and the mixture was blended for thirty minutes. The resulting powder mixture showed no evidence of segregation. The powder was placed in dies and compacted at 50 tsi (7045 Kg/cm$^2$). The wax was burned off, and no evidence of segregation was seen.

EXAMPLE 2

A quantity of 2.268 Kg of type 316 stainless steel powder of conventional mesh was added to a commercial blender. While mixing, 11 ml (0.5% by weight) of toluene sulfonic acid, 57 g (2.5% by weight) of graphite powder and 11 ml (0.5% by weight) of furfuryl alcohol were added to the blender. 1% by weight Acrawax was then added and the mixture was blended for thirty minutes. The resulting powder mixture showed no evidence of segregation. The powder was placed in dies and compacted at 50 tsi (7045 Kg/cm$^2$). The wax was burned off, and the blanks were sintered at 2200° F. (1200° C.) for sixty minutes. The sintered final blanks showed no evidence of segregation and were of acceptable quality.

EXAMPLE 3

A quantity of 6.8 Kg of Eatonite alloy powder of −88 mesh was added to a commercial blender. While mixing, 30 ml (0.44% by weight) of toluene sulfonic, 170 g (2.5% by weight) of graphite and 35 ml (0.5% by weight) of furfuryl alcohol were added to the blender. The mixture was blended for thirty minutes. 70 g (1% by weight) of Acrawax was then added and the mixture was blended for forty five minutes. The resulting powder mixture showed no evidence of segregation. The powder was placed in dies and compacted at 50 tsi (7045 Kg/cm$^2$). The wax was burned off, and the blanks were sintered. The sintered final blanks showed no evidence of segregation and were of acceptable quality.

EXAMPLE 4

A quantity of 6.8 Kg of Eatonite alloy powder of −88 mesh was added to a commercial blender. While mixing, 20 ml (0.3% by weight) of toluene sulfonic, 170 g (2.5% by weight) of graphite and 35 ml (0.5% by weight) of furfuryl alcohol were added to the blender. The mixture was blended for thirty minutes. 70 g (1% by weight) of Acrawax was then added and the mixture was blended for thirty minutes. The resulting powder mixture showed no evidence of segregation. The powder was placed in dies and compacted at 50 tsi (7045 Kg/cm$^2$). The wax was burned off and the blanks were sintered. The sintered final blanks showed no evidence of segregation and were of acceptable quality.

EXAMPLE 5

A quantity of 9.07 Kg of Eatonite alloy powder of −88 mesh was added to a commercial blender. While mixing, 25 ml (0.27% by weight) of toulene sulfonic, 190 g (2% by weight) of graphite and 50 ml (0.55% by weight) of furfuryl alcohol were added to the blender. The mixture was blended for thirty minutes. 68 g of (0.75%) Acrawax was then added and the mixture was blended for forty five minutes. The resulting powder showed no evidence of segregation.

EXAMPLE 6

A quantity of 9.07 Kg of Eatonite alloy powder of −88 mesh was added to a commercial blender. While mixing, 25 ml (0.27% by weight) of toluene sulfonic acid diluted with 25 ml of water, 190 g (2% by weight) of graphite and 50 ml (0.5% by weight) of furfuryl alcohol were added to the blender. The mixture was blended for thirty minutes. 68 g (0.75% by weight) of Acrawax was then added and the mixture was blended for forty-five minutes. The resulting powder showed no evidence of segregation. The powder was placed in dies and compacted at 50 tsi (7045 Kg/cm$^2$). The wax was burned off and the blanks were sintered. The sintered final blanks showed no evidence of segregation and were of acceptable quality.

EXAMPLE 7

A quantity of 9.07 Kg of Eatonite alloy powder of −88 mesh was added to a commercial blender. While mixing, 35 ml (0.38% by weight) of toulene sulfonic acid diluted with 35 ml of water, 250 g (2.75% by weight) of graphite and 70 ml (0.77% by weight) of furfuryl alcohol were added to the blender. The mixture was blended for thirty minutes. 1% by weight of Acrawax was added and the mixture was blended for forty-five minutes. The resulting powder showed no evidence of segregation. The powder was placed in dies and compacted at 50 tsi (7045 Kg/cm$^2$). The wax was burned off and the blanks were sintered at 2250° F. (1230° C.) for ninety minutes. The sintered final blanks showed no evidence of segregation and were of acceptable quality.

EXAMPLE 8

A quantity of 20.41 Kg type 430 stainless steel powder was blended for 45 minutes in a twin shell blender. To this was added 122 ml. (0.6% by weight) of furfuryl alcohol and blended for an additional 30 minutes. Then 106 ml (0.52% by weight) of toluene sulfonic acid was added through a liquid feed bar while mixing. Mixing continued for an additional 5 minutes. 188 g (0.92% by weight) by Acrawax C was added to the above and blended for an additional 60 minutes. Samples of the mixture were taken both before and after blending in the Acrawax. Neither of the samples showed any evidence of graphite segregation.

EXAMPLE 9

A quantity of 20.41 kg of tool steel powder was charged into a twin shell blender. To this was added 82 ml (0.40% by weight) of toluene sulfonic acid and blended for 1 minute. To this mixture was added 163 g. (0.80% by weight) of graphite powder and blended for 1 minute. Then 117 ml (0.57% by weight) of furfuryl alcohol was added through a liquid feed bar and blended for 12 minutes. Then 177 g (0.87% by weight) of Acrawax C was added and blended for 45 minutes.

Samples were taken before and after blending in the Acrawax. Both samples showed no evidence of graphite segregation. Powder from the sample with Acrawax was compacted in a die at 50 tsi (7045 kb/cm$^2$). The green density of the compacted speciments was 6.37 g/cc, and the green modulus of rupture was 930 psi. Both of these values were satisfactory for production of compacted parts.

An analysis for carbon was made on a compacted specimen both before and after sintering. The respective results were 1.15% and 0.98%.

EXAMPLE 10

A quantity of 5.00 kg of tool steel powder was mixed with 62 ml (1.24% by weight) toluene sulfonic acid in a paddle mixer for four minutes. Then 94 ml (1.88% by weight) furfuryl alcohol was added and mixed for ten minutes. At the end of the mixing period the powder was dry and free flowing. A sample showed no segregation, and the green density and green strength of specimens compacted at 50 tsi (7045 kg/cm$^2$) were satisfactory. Another sample was further blended with 1% by weight Acrawax for 60 minutes. This sample also had satisfactory green density and green strength after being compacted at 50 tsi (7045 kg/cm$^2$). Compacted specimens were further sintered and analyzed for carbon. The furfuryl alcohol had been converted to carbon during sintering, leaving a residual carbon level of 0.94%.

It should be understood that the powder additive need not be graphite, but could be boron, phosphorus, silicon or any other powder with specific gravity lower than the metal powder. Further, the method of the present invention has successfully worked when such powder additive has been from 0.5%–6.0% by weight of the metal powder.

What is claimed is:

1. A method of preventing segregation of admixed powder additives from a metallic powder mixture having a higher specific gravity than said powder additive, including the steps of adding during blending to the metallic powder mixture from 0.5–6.0% of an additive powder of lower specific gravity than the metallic powder mixture, 0.5–1.5% by weight of furfuryl alcohol and 0.25–1.0% by weight of an acid sufficient to polymerize the said alcohol during blending whereby to produce a dry and free flowing powder metal blend.

2. The method of claim 1, wherein about 1% by weight of wax lubricant is added to the metallic powder mixture during blending, the metallic powder mixture is placed in dies, compacted and sintered to form final products.

3. The method of claim 2, wherein said compaction takes place at about 50 tsi (7045 Kg/cm$^2$) and said sintering takes place at about 2200° F. (1200° C.) for about sixty minutes.

4. The method of claim 1, wherein said acid is toluene sulfonic acid.

5. The method of claim 1, wherein said additive powder is graphite powder.

* * * * *